US008382976B2

(12) United States Patent
Moran et al.

(10) Patent No.: US 8,382,976 B2
(45) Date of Patent: Feb. 26, 2013

(54) RECOVERY OF BITUMEN FROM FROTH TREATMENT TAILINGS

(75) Inventors: Kevin Moran, Edmonton (CA); Jacques Doiron, Regina (CA); Francis Chachula, Regina (CA); Michael Yakimchuck, Regina (CA)

(73) Assignee: Titanium Corporation Inc., Edmonton, Alberta (CA)

( * ) Notice: Subject to any disclaimer, the term of this patent is extended or adjusted under 35 U.S.C. 154(b) by 966 days.

(21) Appl. No.: 12/426,538

(22) Filed: Apr. 20, 2009

(65) Prior Publication Data

US 2010/0258478 A1 Oct. 14, 2010

(30) Foreign Application Priority Data

Apr. 9, 2009 (CA) ..... 2662346

(51) Int. Cl.
*C10G 1/04* (2006.01)

(52) U.S. Cl. ..... 208/390

(58) Field of Classification Search ..... 208/390
See application file for complete search history.

(56) References Cited

U.S. PATENT DOCUMENTS

| | | | | |
|---|---|---|---|---|
| 3,401,110 | A * | 9/1968 | Floyd et al. | 208/391 |
| 3,594,306 | A * | 7/1971 | Dobson | 208/391 |
| 3,784,464 | A | 1/1974 | Kaminsky | |
| 3,893,907 | A | 7/1975 | Canevari | |
| 3,990,885 | A | 11/1976 | Baillie et al. | |
| 4,035,282 | A * | 7/1977 | Stuchberry et al. | 208/391 |
| 4,226,690 | A | 10/1980 | Martin | |
| 4,676,889 | A * | 6/1987 | Hsieh et al. | 208/391 |
| 7,341,658 | B2 | 3/2008 | Reeves | |
| 7,736,501 | B2 * | 6/2010 | Garner et al. | 208/391 |
| 7,998,342 | B2 * | 8/2011 | Duyvesteyn et al. | 208/391 |
| 8,096,425 | B2 * | 1/2012 | Bjornson et al. | 208/425 |
| 2007/0272596 | A1 | 11/2007 | Erasmus et al. | |

FOREIGN PATENT DOCUMENTS

| | | |
|---|---|---|
| CA | 975696 | 10/1975 |
| CA | 975697 | 10/1975 |
| CA | 975698 | 10/1975 |
| CA | 975699 | 10/1975 |
| CA | 975700 | 10/1975 |
| CA | 1081642 | 7/1980 |
| CA | 1094484 | 1/1981 |
| CA | 1200778 | 2/1986 |
| CA | 1238597 | 6/1988 |
| CA | 1252409 | 4/1989 |
| CA | 2000068 | 4/1991 |
| CA | 2149737 | 3/1999 |
| CA | 2426113 | 10/2003 |
| CA | 2454942 | 7/2005 |
| CA | 2548006 | 11/2007 |

OTHER PUBLICATIONS

R. C. Shaw et al., Suspensions in the Hot Water Flotation Process for Canadian Oil Sands in Suspensions: Fundamentals & Applications in Petroleum Industry, pp. 639-675 (1996).*

Alberta Energy (2002), "Oil Sands Facts", Alberta Department of Energy, 3 pp.

Czarnecki, J. (2001), "Water-in-Oil Emulsions in Recovery of Hydrocarbons from Oil Sands", in Encyclopedia Handbook of Emulsion Technology, J. Sjoblom, Ed., New York pp. 497-514.

Power W.J. (2005) Paper #9, 6th Int'l. Conf. of Petroleum Phase Behaviour and Fouling, Amsterdam, Jun. 19-23 39 pp.

Shaw, R.C. et al. (1996) "Suspension in the Hot Water Flotation Process for Canadian Oil Sands", in Suspensions: Fundamental & Appls. in the Petroleum Industry . . . pp. 639-675.

* cited by examiner

*Primary Examiner* — Randy Boyer
(74) *Attorney, Agent, or Firm* — Rodman & Rodman; Terrence N. Kuharchuk

(57) ABSTRACT

A method for recovering a tailings bitumen from a froth treatment tailings, including providing a first feed material which is derived from the froth treatment tailings, conditioning the first feed material in order to produce a conditioned first feed material, providing a second feed material which is derived from the conditioned first feed material, and subjecting the second feed material to solvent extraction in order to produce an extract containing an amount of the tailings bitumen. The method may further include dewatering the conditioned first feed material in order to produce the second feed material and may further include clarifying the extract to produce a clarified extract containing an amount of the tailings bitumen.

40 Claims, 5 Drawing Sheets

| STREAM N0. | 24 | 42 | 46 | 60 | 60/104 | 70/100 | 102 |
|---|---|---|---|---|---|---|---|
| STREAM DESCRIPTION | First Feed Material | Conditioned First Feed Material | Froth Flotation Tailings | Second Feed Material | Second Feed Material/Second Stage Extraction Overflow Product | Extract/First Stage Extraction Overflow Product | First Stage Extraction Underflow Product |
| | | | | | | | |
| Bitumen (kg) | 6.66 | 5.6 | 1.06 | 6.56 | 7.52 | 5.2 | 1.36 |
| Water (kg) | 289.71 | 131.2 | 158.51 | 131.325 | 131.45 | 0.25 | 133.2 |
| Solid Mineral Material (kg) | 36.297 | 23.04 | 13.257 | 23.0713 | 23.103 | 0.375 | 23.04 |
| Naphtha (kg) | 0.333 | 0.16 | 0.173 | 19.56 | 38.96 | 19.175 | 2.4 |
| | | | | | | | |
| Total Mass (kg) | 333 | 160 | 173 | 185 | 201.033 | 25 | 160 |
| | | | | | | | |
| Solvent to Bitumen Ratio (wt./wt.) | | | | | 5.18 | | |
| Solvent to Feed Ratio (wt./wt.) | | | | | 0.194 | | |
| | | | | | | | |
| Bitumen (%wt.) | 2 | 3.5 | .6127 | 3.55 | | 20.8 | 0.85 |
| Water (%wt.) | 87 | 82 | 91.624 | 70.99 | | 1.1 | 81.92 |
| Solid Mineral Material (%wt.) | 10.9 | 14.4 | 7.66 | 12.47 | | 1.4 | 15.73 |
| Naphtha (%wt.) | 0.1 | 0.1 | 0.1 | 10.57 | | 76.7 | 1.5 |
| | | | | | | | |
| Total (%wt.) | 100 | 100 | 100 | 100 | | 100 | 100 |
| | | | | | | | |
| Bitumen Recovery (%) | | 84.1 | | | | 78.1 | |

Figure 2

| STREAM N0. | 108 | 102/108 | 104 | 72/106 | 130 | 120 | 122 |
|---|---|---|---|---|---|---|---|
| STREAM DESCRIPTION | Hydrocarbon Diluent | First Stage Extraction Underflow Product/ Hydrocarbon Diluent | Second Stage Extraction Overflow Product | Raffinate/Second Stage Extraction Underflow Product | Water | Clarified Extract | Clarifying Tailings |
| | | | | | | | |
| Bitumen (kg) | | 1.36 | 0.96 | 0.4 | | 5.18 | 0.018 |
| Water (kg) | | 133.2 | 0.125 | 128.94 | 5 | 0.124 | 4.81 |
| Solid Mineral Material (kg) | | 23.04 | 0.032 | 22.67 | | 0.025 | 0.35 |
| Naphtha (kg) | 25 | 27.4 | 19.4 | 8 | | 19.419 | 0.0677 |
| | | | | | | | |
| Total Mass (kg) | 25 | 185 | 25 | 160 | 5 | 24.75 | 5.25 |
| | | | | | | | |
| Solvent to Bitumen Ratio (wt./wt.) | | 20.15 | | | | | |
| Solvent to Feed Ratio (wt./wt.) | | 0.148 | | | | | |
| | | | | | | | |
| Bitumen (%wt.) | | 1 | 3.84 | 0.25 | | 20.939 | 0.35 |
| Water (%wt.) | | 72 | 0.5 | 80.58 | 100 | 0.5 | 91.69 |
| Solid Mineral Material (%wt.) | | 12 | 0.125 | 14.17 | | 0.1 | 6.67 |
| Naphtha (%wt.) | 100 | 15 | 95.535 | 5 | | 78.4641 | 1.29 |
| | | | | | | | |
| Total (%wt.) | 100 | 100 | 100 | 100 | 100 | 100 | 100 |
| | | | | | | | |
| Bitumen Recovery (%) | | | | | | 77.8 | |

Figure 2 (continued)

| STREAM N0. | 24 | 42 | 46 | 60 | 60/104 | 70/100 | 102 |
|---|---|---|---|---|---|---|---|
| STREAM DESCRIPTION | First Feed Material | Conditioned First Feed Material | Froth Flotation Tailings | Second Feed Material | Second Feed Material/Second Stage Extraction Overflow Product | Extract/First Stage Extraction Overflow Product | First Stage Extraction Underflow Product |
| | | | | | | | |
| Bitumen (kg) | | | | 0.55 | 0.56 | 0.51 | 0.05 |
| Water (kg) | | | | 3.86 | 3.89 | 0.1 | 3.76 |
| Solid Mineral Material (kg) | | | | 0.58 | 0.59 | 0.01 | 0.58 |
| Diluent (kg) | | | | 0.02 | 1.91 | 1.34 | 0.57 |
| | | | | | | | |
| Total Mass (kg) | | | | 5 | 6.95 | 1.95 | 5 |
| | | | | | | | |
| Solvent to Bitumen Ratio (wt./wt.) | | | | | 3.41 | | |
| Solvent to Feed Ratio (wt./wt.) | | | | | 0.27 | | |
| | | | | | | | |
| Bitumen (%wt.) | | | | 11 | 8.01 | 26 | 1.0 |
| Water (%wt.) | | | | 77.2 | 56.03 | 5 | 75.93 |
| Solid Mineral Material (%wt.) | | | | 11.6 | 8.55 | 0.3 | 11.6 |
| Diluent (%wt.) | | | | 0.4 | 27.41 | 68.7 | 11.4 |
| | | | | | | | |
| Total (%wt.) | | | | | 100 | 100 | 100 |
| | | | | | | | |
| Bitumen Recovery (%) | | | | | | 92.7 | |

Figure 3

| STREAM N0. | 108 | 102/108 | 104 | 72/106 | 130 | 120 | 122 |
|---|---|---|---|---|---|---|---|
| STREAM DESCRIPTION | Hydrocarbon Diluent | First Stage Extraction Underflow Product and Hydrocarbon Diluent | Second Stage Extraction Overflow Product | Raffinate/Second Stage Extraction Underflow Product | Water | Clarified Extract | Clarifying Tailings |
| | | | | | | | |
| Bitumen (kg) | | 0.05 | 0.01 | 0.04 | | 0.49 | 0.024 |
| Water (kg) | | 3.76 | 0.04 | 3.72 | 0.1 | 0.03 | 0.17 |
| Solid Mineral Material (kg) | | 0.58 | 0.004 | 0.57 | | 0.007 | 0.002 |
| Diluent (kg) | 1.36 | 1.93 | 1.85 | 0.1 | | 1.32 | 0.02 |
| | | | | | | | |
| Total Mass (kg) | 1.36 | 6.32 | 1.90 | 4.42 | 0.1 | 1.85 | 0.21 |
| | | | | | | | |
| Solvent to Bitumen Ratio (wt./wt.) | | 38.6 | | | | | |
| Solvent to Feed Ratio (wt./wt.) | | 0.31 | | | | | |
| | | | | | | | |
| Bitumen (%wt.) | | 0.8 | 0.53 | 0.9 | | 27.29 | 0.7 |
| Water (%wt.) | | 59.5 | 2.1 | 84.2 | 100 | 1.5 | 86.21 |
| Solid Mineral Material (%wt.) | | 9.1 | 0.21 | 12.9 | | 0.2 | 1.09 |
| Diluent (%wt.) | 100 | 30.5 | 97.68 | 2.3 | | 71.01 | 12.0 |
| | | | | | | | |
| Total (%wt.) | 100 | 100 | 100 | 100 | 100 | 100 | 100 |
| | | | | | | | |
| Bitumen Recovery (%) | | | | | | 89.0 | |

Figure 3 (continued)

RECOVERY OF BITUMEN FROM FROTH TREATMENT TAILINGS

TECHNICAL FIELD

A method for recovering bitumen from froth treatment tailings.

BACKGROUND OF THE INVENTION

Oil sand is essentially comprised of a matrix of bitumen, solid mineral material and water.

The bitumen component of oil sand includes hydrocarbons which are typically quite viscous at normal in situ temperatures and which act as a binder for the other components of the oil sand. For example, bitumen has been defined by the United Nations Institute for Training and Research as a hydrocarbon with a viscosity greater than $10^4$ mPa s (at deposit temperature) and a density greater than 1000 kg/m$^3$ at 15.6 degrees Celsius.

The solid mineral material component of oil sand typically consists of sand, rock, silt and clay. Solid mineral material may be present in oil sand as coarse solid mineral material or fine solid mineral material. The accepted division between coarse solid mineral material and fine solid mineral material is typically a particle size of about 44 microns. Solid mineral material having a particle size greater than about 44 microns is typically considered to be coarse solid mineral material, while solid mineral material having a particle size less than about 44 microns is typically considered to be fine solid mineral material. Sand and rock are generally present in oil sand as coarse solid mineral material, while silt and clay are generally present in oil sand as fine solid mineral material.

A typical deposit of oil sand may contain (by weight) about 10 percent bitumen, up to about 6 percent water, with the remainder being comprised of solid mineral material, which may include a relatively small amount of impurities such as humic matter and heavy minerals.

Water based technologies are typically used to extract bitumen from oil sand ore originating from the Athabasca area in northeastern Alberta, Canada. A variety of water based technologies exist, including the Clark "hot water" process and a variety of other processes which may use hot water, warm water or cold water in association with a variety of different separation apparatus.

In a typical water based oil sand extraction process, the oil sand ore is first mixed with water to form an aqueous slurry. The slurry is then processed to release bitumen from within the oil sand matrix and prepare the bitumen for separation from the slurry, thereby providing a conditioned slurry. The conditioned slurry is then processed in one or more separation apparatus which promote the formation of a primary bitumen froth while rejecting coarse solid mineral material and much of the fine solid mineral material and water. The separation apparatus may also produce a middlings stream from which a secondary bitumen froth may be scavenged. This secondary bitumen froth may be added to the primary bitumen froth or may be kept separate from the primary bitumen froth.

A typical bitumen froth (comprising a primary bitumen froth and/or a secondary bitumen froth) may contain (by weight) about 60 percent bitumen, about 30 percent water and about 10 percent solid mineral material, wherein a large proportion of the solid mineral material is fine solid mineral material. The bitumen which is present in a typical bitumen froth is typically comprised of both non-asphaltenic material and asphaltenes.

This bitumen froth is typically subjected to a froth treatment process in order to reduce its solid mineral material and water concentration by separating the bitumen froth into a bitumen product and froth treatment tailings.

In a typical froth treatment process, the bitumen froth is diluted with a froth treatment diluent to provide a density gradient between the hydrocarbon phase and the water phase and to lower the viscosity of the hydrocarbon phase. The diluted bitumen froth is then subjected to separation in one or more separation apparatus in order to produce the bitumen product and the froth treatment tailings. Exemplary separation apparatus include gravity settling vessels, inclined plate separators and centrifuges.

Some commercial froth treatment processes use naphthenic type diluents (defined as froth treatment diluents which consist of or contain a significant amount of one or more aromatic compounds). Examples of naphthenic type diluents include toluene (a light aromatic compound) and commercial naphtha, which may be comprised of both aromatic and non-aromatic compounds.

Other commercial froth treatment processes use paraffinic type diluents (defined as froth treatment diluents which consist of or contain significant amounts of one or more relatively short-chained aliphatic compounds). Examples of paraffinic type diluents are C4 to C8 aliphatic compounds and natural gas condensate, which typically contains short-chained aliphatic compounds and may also contain small amounts of aromatic compounds.

Froth treatment processes which use naphthenic type diluents (i.e., naphthenic processes) typically result in a relatively high bitumen recovery (perhaps about 98 percent), but also typically result in a bitumen product which has a relatively high solid mineral material and water concentration (also described as "bottom sediment and water concentration" or "BS&W content").

Froth treatment processes which use paraffinic type diluents (i.e., paraffinic processes) typically result in a relatively lower bitumen recovery (in comparison with naphthenic processes), and in a bitumen product which has a relatively lower BS&W content (in comparison with naphthenic processes). Both the relatively lower bitumen recovery and the relatively lower BS&W content may be attributable to the phenomenon of asphaltene precipitation, which occurs in paraffinic processes when the concentration of the paraffinic type diluent exceeds a critical level. This asphaltene precipitation results in bitumen being lost to the froth treatment tailings, but also provides a cleaning effect in which the precipitating asphaltenes trap solid mineral material and water as they precipitate, thereby separating the solid mineral material and the water from the bitumen froth.

Froth treatment tailings therefore typically contain solid mineral material, water, froth treatment diluent, and small amounts of residual tailings bitumen (perhaps about 2-12 percent of the bitumen which was contained in the original bitumen froth). Much of the froth treatment diluent is typically recovered from the froth treatment tailings in a tailings solvent recovery unit (TSRU). The froth treatment tailings (including the tailings bitumen) are then typically disposed of in a tailings pond. As a result, a significant amount of bitumen from the original oil sand ore is typically lost to the froth treatment tailings as tailings bitumen. There are both environmental incentives and economic incentives for recovering all or a portion of this tailings bitumen.

Canadian Patent Application No. 2,548,006 (Erasmus et al) and corresponding U.S. Patent Application Publication No. US 2007/0272596 A1 (Erasmus et al) describe a process for recovering heavy minerals from oil sand tailings (i.e., froth treatment tailings) in which the tailings are first "deslimed" in a desliming means in order to remove a portion of the free fines and residual bitumen therefrom. The desliming means is comprised of one or more enhanced gravity separators, such as hydrocyclones or centrifuges. The deslimed oil sand tailings are then processed by being sequentially attritioned in an attritioner and separated in a separation means to separate the heavy minerals from other coarse solids present in the deslimed oil sand tailings and produce a concentrated heavy minerals fraction. The attritioner may be a Denver Cell™ type attritioner. The separation means may be comprised of a wide variety of separation apparatus and/or of combinations of such separation apparatus. The concentrated heavy minerals fraction may be further processed to remove residual bitumen therefrom and thereby produce a washed concentrated heavy minerals fraction. No processing is described for the slimes which are removed by the desliming means.

Canadian Patent No. 1,081,642 (Porteous) describes a method for treating froth treatment tailings obtained directly from a dilution centrifuging circuit which comprises introducing the tailings into a flotation cell, subjecting the tailings to agitation and flotation using gas introduced into the base of the body of tailings in order to recover bitumen and diluent as froth and in order to reject a portion of the solids and water as underflow, and removing the froth from further treatment.

Canadian Patent No. 1,094,484 (Lane et al) describes a method similar to the method in Porteous, with the added steps of mixing the froth with a further portion of hydrocarbon diluent, treating the diluted froth in a scroll-type centrifugal separator to reject solids, water and a minor part of the hydrocarbons as tailings and produce a first product stream comprising hydrocarbons, water and a minor part of the solids, and treating the first product stream in a disc-type centrifugal separator to reject water, solids and a minor part of the hydrocarbons as tailings and produce a second product stream comprising hydrocarbons and a minor part of the water and solids.

Canadian Patent No. 1,252,409 (St. Amour et al) describes a method for recovering bitumen from a waste sludge obtained from a retention pond used to store tailings from water extraction of bitumen from tar sands. The tailings comprising the waste sludge are collected from various processing steps of the "hot water" process for primary extraction of bitumen from tar sands. The method includes the steps of conditioning the sludge by removing carbon dioxide and methane and thereafter reducing the viscosity of the sludge, subjecting the conditioned sludge to air flotation in an induced air type of flotation cell in order to obtain a froth, subjecting the froth to a froth settler wherein the mineral tailings are drained off and delivered to a cleaner cell for further processing, diluting the froth from the froth settler with water, deaerating the diluted froth, and separating a bitumen product from the froth. Separating the bitumen product from the froth includes diluting the deaerated froth with hot naphtha and heating the froth, feeding the diluted and heated froth to a hydrocyclone, feeding the overflow from the hydrocyclone to a centrifuge, and recovering the overflow from the centrifuge as the bitumen product.

There remains a need for methods for recovering bitumen from froth treatment tailings.

SUMMARY OF THE INVENTION

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

In this document, "gravity settling" means an operation in which components of a mixture are separated using gravity, and is therefore distinguished from other separation operations such as molecular sieve processes, absorption processes, adsorption processes, magnetic processes, electrical processes, enhanced gravity settling processes, etc.

In this document, "gravity settler" includes a gravity settling vessel, an inclined plate separator, a rotary disc contactor, a thickener, and any other suitable apparatus which facilitates gravity settling, with or without the use of process aids such as flocculants and demulsifiers. In this document, gravity settler also includes a mixing apparatus which may be used in association with the gravity settling operation.

In this document, "gravity settling vessel" means a tank or other vessel into which a mixture may be introduced in order to facilitate separation of the mixture using gravity, but is distinguishable from an inclined plate separator. A gravity settling vessel may have any shape, size and/or configuration which is suitable for achieving gravity separation. A gravity settling vessel may or may not include internal structures such as weirs, sumps, launders, baffles, distributors, etc. and may or may not include internal mechanical devices such as rakes, conveyors, augers, etc.

In this document, "inclined plate separator" means an apparatus which is comprised of a plurality of stacked inclined plates onto which a mixture to be separated may be introduced so that the mixture passes along the plates in order to achieve separation of components of the mixture, and is distinguishable from a gravity settling vessel.

In this document, "enhanced gravity separation" means an operation in which components of a mixture are separated using centrifugal acceleration or centripetal acceleration resulting from rotational movement of the mixture, and is therefore distinguished from gravity separation processes.

In this document, "enhanced gravity separator" or "enhanced gravity separation apparatus" includes a centrifuge, a hydrocyclone and any other suitable apparatus which facilitates enhanced gravity separation.

In this document, "solvent extraction" means an operation in which components of a mixture are separated by adding to the mixture a suitable liquid solvent which dissolves or dilutes one or more components of the mixture, thereby facilitating separation of components of the mixture.

In this document, "solvent extraction apparatus" includes gravity settlers (including without limitation, gravity settling vessels, inclined plate separators, and rotary disc contactors) and enhanced gravity separators (including without limitation, centrifuges and hydrocyclones).

In this document, "froth treatment diluent" means any substance containing one or more hydrocarbon compounds and/or substituted hydrocarbon compounds which is suitable for use in diluting bitumen froth in a froth treatment process.

In this document, "hydrocarbon diluent" means any substance containing one or more hydrocarbon compounds and/or substituted hydrocarbon compounds which is suitable for use for diluting bitumen in the practice of the invention.

In this document, "naphthenic type diluent" means a froth treatment diluent or a hydrocarbon diluent which includes a sufficient amount of one or more aromatic compounds so that the diluent essentially exhibits the properties of a naphthenic type diluent as recognized in the art, as distinguished from a paraffinic type diluent. In this document, a naphthenic type diluent may therefore be comprised of a mixture of aromatic and non-aromatic compounds, including but not limited to such substances as naphtha (i.e., commercial naphtha) and toluene.

In this document, "paraffinic type diluent" means a froth treatment diluent or a hydrocarbon diluent which includes a sufficient amount of one or more relatively short-chain aliphatic compounds (such as, for example, C5 to C8 aliphatic compounds) so that the diluent essentially exhibits the properties of a paraffinic type diluent as recognized in the art, as distinguished from a naphthenic type diluent. In this document, a paraffinic type diluent may therefore be comprised of a mixture of aliphatic and non-aliphatic compounds, including but not limited to such substances as natural gas condensate.

In this document, "froth flotation" means an operation in which components of a mixture are separated by passing a gas through the mixture so that the gas causes one or more components of the mixture to float to the top of the mixture and form a froth. In this document, froth flotation may be performed using flotation cells or tanks, flotation columns or any other suitable froth flotation apparatus, which may or may not include agitators or mixers, and froth flotation may include the use of flotation aids, including without limitation, surfactants and frothing agents.

The present invention is a method for recovering bitumen from froth treatment tailings (i.e., tailings bitumen), wherein the froth treatment tailings result from a process for recovering bitumen from oil sand, wherein the process for recovering bitumen from oil sand is comprised of producing a bitumen froth from the oil sand, and wherein the process for recovering bitumen from oil sand is further comprised of separating the froth treatment tailings from the bitumen froth in a froth treatment process.

The method is performed on a feed material which is derived from the froth treatment tailings. The feed material may therefore be comprised of the froth treatment tailings in their entirety, may be comprised of one or more components of the froth treatment tailings, or may be comprised of one or more products resulting from the processing of the froth treatment tailings.

The feed material may be further comprised of an amount of a froth treatment diluent which is present as a result of separating the froth treatment tailings from the bitumen froth. Alternatively, the feed material may contain little or no froth treatment diluent, either because the froth treatment diluent has been recovered from the froth treatment tailings in a tailings solvent recovery unit (TSRU) process or a similar process or because the separation of the froth treatment tailings from the bitumen froth has not required the use of a froth treatment diluent.

Where the feed material is comprised of a froth treatment diluent, the froth treatment diluent may be comprised of a naphthenic type diluent and/or a paraffinic type diluent.

In a first exemplary aspect, the invention is a method for recovering tailings bitumen from a froth treatment tailings, the method comprising:

(a) providing a first feed material which is derived from the froth treatment tailings;
(b) conditioning the first feed material in order to produce a conditioned first feed material;
(c) providing a second feed material which is derived from the conditioned first feed material; and
(d) subjecting the second feed material to solvent extraction in order to produce an extract comprising tailings bitumen.

In a second exemplary aspect, the invention is a method for recovering a tailings bitumen from a froth treatment tailings comprising solid mineral material, water, and an original amount of the tailings bitumen, wherein the froth treatment tailings result from a process for recovering bitumen from oil sand, wherein the process for recovering bitumen from oil sand is comprised of producing a bitumen froth from the oil sand, and wherein the process for recovering bitumen from oil sand is further comprised of separating the froth treatment tailings from the bitumen froth in a froth treatment process, the method comprising:

(a) providing a first feed material which is derived from the froth treatment tailings, wherein the first feed material is comprised of solid mineral material, water, and a first feed material amount of the tailings bitumen;
(b) conditioning the first feed material in order to produce a conditioned first feed material, wherein conditioning the first feed material is comprised of agitating the first feed material in order to facilitate separation of the tailings bitumen from the solid mineral material, and wherein the conditioned first feed material is comprised of solid mineral material, water, and a conditioned first feed material amount of the tailings bitumen;
(c) providing a second feed material which is derived from the conditioned first feed material, wherein the second feed material is comprised of solid mineral material, water, and a second feed material amount of the tailings bitumen; and
(d) subjecting the second feed material to solvent extraction in order to produce an extract comprising solid mineral material, water, and an extract amount of the tailings bitumen.

In some particular embodiments, the first feed material may be comprised of the froth treatment tailings in their entirety. In some particular embodiments, the froth treatment tailings have been separated into a coarse mineral material fraction (comprising a minimal amount of solid mineral material having a particle size less than about 44 microns) and a fine mineral material fraction (comprising a minimal amount of solid mineral material having a particle size greater than about 44 microns) and the fine mineral material fraction is provided as the first feed material.

In some particular embodiments, the method may be further comprised of separating the froth treatment tailings into the coarse mineral material fraction and the fine mineral material fraction. The froth treatment tailings may be separated into the coarse mineral material fraction and the fine mineral material fraction in any suitable manner. In some particular embodiments, the method may be further comprised of separating the froth treatment tailings into the coarse mineral material fraction and the fine mineral material fraction by subjecting the froth treatment tailings to hydrocycloning.

The purpose of conditioning the first feed material is to prepare the feed material for solvent extraction. Conditioning the first feed material may be comprised of agitating the first feed material in order to facilitate separation of the tailings bitumen from the solid mineral material. Agitating the first feed material may be comprised of imparting kinetic energy to the first feed material for the purpose of enabling interaction and blending amongst constituents of the first feed material. The first feed material may be agitated in any suitable manner, including, without limitation, by mixing and/or by stirring.

Agitating the first feed material may be comprised of subjecting the first feed material to an agitation intensity, which may be expressed in watts per kilogram of first feed material which is agitated. In some embodiments, the agitation intensity may be at least about 25 watts per kilogram. In some embodiments, the agitation intensity may be between about 25 watts per kilogram and about 2000 watts per kilogram. In some embodiments, the agitation intensity may be between about 200 watts per kilogram and about 1500 watts per kilogram. In some embodiments, the agitation intensity may be between about 500 watts per kilogram and about 1200 watts per kilogram.

Agitating the first feed material may have an agitation duration, which may be expressed as the length of time for which the first feed material is agitated. In some embodiments, the agitation duration may be at least about 5 minutes. In some embodiments, the agitation duration may be at between about 5 minutes and about 40 minutes. In some embodiments, the agitation duration may be between about 5 minutes and about 30 minutes. In some embodiments, the agitation duration may be between about 10 minutes and about 20 minutes.

Conditioning the first feed material may be further comprised of concentrating the first feed material so that a concentration of the tailings bitumen by weight in the conditioned first feed material is higher than a concentration of the tailings bitumen by weight in the first feed material. The first feed material may be concentrated in any suitable manner.

In some particular embodiments, concentrating the first feed material may be performed so that the concentration of the tailings bitumen by weight in the conditioned first feed material is between about 1.25 times and about 3 times the concentration of the tailings bitumen by weight in the first feed material. In some particular embodiments, concentrating the first feed material may be performed so that the concentration of the tailings bitumen by weight in the conditioned first feed material is between about 2 times and about 3 times the concentration of the tailings bitumen by weight in the first feed material.

In some particular embodiments, the first feed material may be concentrated by subjecting the first feed material to froth flotation in order to produce the conditioned first feed material as an overflow product. Subjecting the first feed material to froth flotation may be performed using any suitable froth flotation apparatus.

Subjecting the first feed material to froth flotation may be comprised of subjecting the first feed material to a froth flotation intensity, which may be expressed in kilograms of added air per kilogram of first feed material which is subjected to froth flotation. In some embodiments, the froth flotation intensity may be at least about 0.00005 kilograms of added air per kilogram of first feed material. In some embodiments, the froth flotation intensity may be between about 0.00005 kilograms and about 0.05 kilograms of added air per kilogram of first feed material. In some embodiments, the froth flotation intensity may be between about 0.01 kilograms and about 0.03 kilograms of added air per kilogram of first feed material. In some embodiments, the froth flotation intensity may be between about 0.01 and about 0.02 kilograms of added air per kilogram of first feed material.

The froth flotation may have a froth flotation duration, which may be expressed as the length of time for which the first feed material is subjected to froth flotation. In some embodiments, the froth flotation duration may be at least about 5 minutes. In some embodiments, the froth flotation duration may be between about 5 minutes and about 40 minutes. In some embodiments, the froth flotation duration may be between about 5 minutes and about 30 minutes. In some embodiments, the froth flotation duration may be between about 10 minutes and about 20 minutes.

In some particular embodiments, subjecting the first feed material to froth flotation may be comprised of agitating the first feed material so that agitating the first feed material and concentrating the first feed material are both comprised of subjecting the first feed material to froth flotation. In some particular embodiments, agitating the first feed material may be performed separately from concentrating the first feed material.

In some embodiments in which agitating the first feed material and concentrating the first feed material are both comprised of subjecting the first feed material to froth flotation, the first feed material may be subjected to the agitation intensity during the froth flotation in addition to being subjected to the froth flotation intensity.

Subjecting the second feed material to solvent extraction may be comprised of adding an amount of a hydrocarbon diluent to the second feed material. The hydrocarbon diluent may be comprised of or consist of any suitable naphthenic type diluent or any suitable paraffinic type diluent.

In embodiments in which the hydrocarbon diluent is comprised of a paraffinic type diluent, the amount of the paraffinic type diluent is preferably selected so that the precipitation of asphaltenes from the second feed material is minimized and so that the recovery of tailings bitumen from the second feed material is maximized.

In some particular embodiments in which the hydrocarbon diluent is comprised of a naphthenic type diluent, the hydrocarbon diluent may be comprised of or consist of naphtha or toluene. In some particular embodiments in which the hydrocarbon diluent is comprised of or consists of naphtha, the naphtha may have an aromaticity of between about 10 and 20 percent.

The performance of toluene as the hydrocarbon diluent in the solvent extraction and the performance of naphtha as the hydrocarbon diluent in the solvent extraction may be dependent upon the solvent to feed material ratio by weight, upon the solvent to bitumen ratio by weight, upon the temperature at which the solvent extraction is performed, and upon the length of time for which the solvent extraction is performed.

At equivalent values of solvent to feed material ratio by weight and equivalent temperatures, the extent of recovery of tailings bitumen from the second feed material in the solvent extraction may generally be greater if the hydrocarbon diluent consists of toluene than if the hydrocarbon diluent consists of naphtha.

In embodiments in which the hydrocarbon diluent consists essentially of toluene, the extent of recovery of tailings bitumen from the second feed material in the solvent extraction may be relatively insensitive to the solvent to feed material ratio by weight.

In embodiments in which the hydrocarbon diluent consists essentially of naphtha, the extent of recovery of tailings bitumen from the second feed material in the solvent extraction may be maximized if the solvent to feed material ratio by weight is relatively low (i.e., less than or equal to about 0.5).

In embodiments in which the hydrocarbon diluent consists essentially of naphtha, the water concentration in the extract produced by the solvent extraction may decrease as the temperature at which the solvent extraction is performed increases if the solvent to feed material ratio by weight is relatively low (i.e., less than or equal to about 0.5).

In embodiments in which the second feed material is comprised of an amount of a froth treatment diluent, the hydrocarbon diluent is preferably selected having regard to the composition of the froth treatment diluent.

As a first consideration, in some applications it may be convenient for the composition of the froth treatment diluent and the composition of the hydrocarbon diluent to be similar so that a single type of diluent can be provided for both froth treatment and for the practice of the invention.

However, as a second consideration, the use of a paraffinic type diluent as the hydrocarbon diluent where the second feed material is comprised of an amount of a paraffinic type diluent as the froth treatment diluent may not be effective to recover precipitated asphaltenes from the second feed material, unless the concentration of the hydrocarbon diluent during solvent extraction can be maintained below the critical level which results in significant asphaltene precipitation. Stated otherwise, the use of a paraffinic type diluent as the hydrocarbon diluent may be reasonably effective for recovering non-asphaltenic bitumen material from the second feed material, but may be less effective for recovering asphaltenes from the second feed material.

As a result, where the second feed material is comprised of an amount of a naphtha type diluent as the froth treatment diluent, the hydrocarbon diluent may also be comprised of a naphtha type diluent, since asphaltene precipitation is not a major concern. Where the second feed material is comprised of an amount of a naphtha type diluent as the froth treatment diluent, the hydrocarbon diluent may be comprised of a paraffinic type diluent if recovery of asphaltenes from the second feed material is not essential or if the concentration of the paraffinic type diluent can be maintained below the critical level which results in significant asphaltene precipitation. Where the second feed material is comprised of an amount of a paraffinic type diluent as the froth treatment diluent, the hydrocarbon diluent may be comprised of a naphtha type diluent, since the naphtha type diluent may facilitate the recovery of asphaltenes from the second feed material. Where the second feed material is comprised of an amount of a paraffinic type diluent, the hydrocarbon diluent may be comprised of a paraffinic type diluent if recovery of asphaltenes from the second feed material is not essential of if the concentration of the paraffinic type diluent can be maintained below the critical level which results in significant asphaltene precipitation.

Subjecting the second feed material to solvent extraction may be further comprised of passing the second feed material through one or more stages of solvent extraction apparatus. The stages of solvent extraction apparatus may be comprised of any suitable solvent extraction apparatus or combination of solvent extraction apparatus. A plurality of stages of solvent extraction apparatus may be arranged in any suitable configuration, including without limitation, a co-current configuration or a countercurrent configuration.

In some particular embodiments, subjecting the second feed material to solvent extraction may be further comprised of subjecting the second feed material to gravity settling. In some particular embodiments, subjecting the second feed material to solvent extraction may be further comprised of passing the second feed material through a plurality of stages of gravity settlers arranged in a countercurrent configuration. In some particular embodiments, the number of stages of gravity settlers may be two. In some particular embodiments, the number of stages of gravity settlers may be three or more. In some particular embodiments, the gravity settlers may be comprised of gravity settling vessels, inclined plate separators, rotary disc contactors, and combinations thereof.

The amount of hydrocarbon diluent which is added to the second feed material may be selected to provide a desired solvent to feed material ratio by weight in the second feed material. Alternatively, the amount of hydrocarbon diluent which is added to the second feed material may be selected to provide a desired solvent to bitumen ratio by weight in the second feed material.

In some particular embodiments, the desired solvent to feed material ratio by weight and/or the desired solvent to bitumen ratio by weight may be increased as the second feed material is passed through each stage of solvent extraction apparatus.

In embodiments in which the first feed material is comprised of an amount of a froth treatment diluent, the solvent to feed material ratio may be determined having regard to both the composition and the amount of the froth treatment diluent which is included in the first feed material.

In some embodiments in which the hydrocarbon diluent and the froth treatment diluent consist essentially of a naphthenic type diluent, the second feed material may be subjected to a first stage of solvent extraction in which a solvent to bitumen ratio is generally between about 1 and about 10 by weight, and the second feed material may be subjected to a second stage of solvent extraction in which the solvent to feed material ratio is generally between about 5 and about 100 by weight.

In some embodiments in which the hydrocarbon diluent and the froth treatment diluent consist essentially of a naphthenic type diluent, the second feed material may be subjected to a first stage of solvent extraction in which a solvent to feed material ratio is generally between about 0.09 and about 1 by weight, and the second feed material may be subjected to a second stage of solvent extraction in which the solvent to feed material ratio is generally between about 0.1 and about 1 by weight.

In some embodiments in which the hydrocarbon diluent and the froth treatment diluent consist essentially of naphtha as a naphthenic type diluent, the second feed material may be subjected to a first stage of solvent extraction in which the solvent to feed material ratio is between about 0.09 and about 0.75 by weight, between about 0.09 and about 0.5 by weight, or between about 0.09 and about 0.25 by weight.

In some embodiments in which the hydrocarbon diluent and the froth treatment diluent consist essentially of naphtha as a naphthenic type diluent, the second feed material may be subjected to a second stage of solvent extraction in which the solvent to feed material ratio is between about 0.1 and about 1 by weight, between about 0.1 and about 0.5 by weight, or between about 0.1 and about 0.3 by weight.

In some embodiments in which the hydrocarbon diluent and the froth treatment diluent consist essentially of toluene as a naphthenic type diluent, the second feed material may be subjected to a first stage of solvent extraction in which the solvent to feed material ratio is between about 0.1 and about 0.9 by weight, between about 0.1 and about 0.5 by weight, or between about 0.2 and about 0.4 by weight.

In some embodiments in which the hydrocarbon diluent and the froth treatment diluent consist essentially of toluene as a naphthenic type diluent, the second feed material may be subjected to a second stage of solvent extraction in which the solvent to feed material ratio is between about 0.1 and about 1 by weight, between about 0.2 and about 0.5 by weight, or between about 0.2 and about 0.5 by weight.

Although naphtha and toluene are both naphthenic type diluents, the performance of naphtha in solvent extraction may be more sensitive to the solvent to feed material ratio than is the performance of toluene in solvent extraction. In particular, and as described above, in some embodiments in which the hydrocarbon diluent and the froth treatment diluent consist essentially of naphtha as a naphthenic type diluent, the extent of recovery of tailings bitumen from the second feed material may be maximized and the solid mineral material concentration in the extract may be minimized by providing a solvent to feed material ratio which is relatively low (i.e. less than or equal to about 0.5).

In some embodiments in which the hydrocarbon diluent and the froth treatment diluent consist essentially of a paraffinic type diluent, the second feed material may be subjected to solvent extraction under conditions in which the solvent to feed material ratio by weight may be less than a solvent to feed material ratio which will result in significant asphaltene precipitation.

In some particular embodiments, the extract may have a solid mineral material concentration by weight, a water concentration by weight, and/or a combined solid mineral material concentration and water concentration by weight (i.e., BS&W content) which is higher than desired. For example, the extract may have a solid mineral material concentration and/or a water concentration which exceeds the limits which must be met for processing or transport of the extract as a diluted bitumen (i.e., dilbit) product.

As a result, in some particular embodiments, the method may be further comprised of clarifying the extract in order to reduce the solid mineral material concentration, the water concentration and/or the BS&W content of the extract and thereby produce a clarified extract. The extract may be clarified in any suitable manner, including without limitation, by using gravity settling or enhanced gravity separation in order to produce the clarified extract as an overflow product and/or by using electrostatic precipitation to produce the clarified extract as a purified product. Clarifying the extract may be comprised of adding a demulsifier and/or an amount of water to the extract in order to facilitate the separation of solid mineral material and/or water from the extract.

In some particular embodiments, the extract may have a solid mineral material concentration which is greater than or equal to about 0.1 percent and clarifying the extract may be performed so that the clarified extract has a solid mineral material concentration which is less than about 0.1 percent.

In some particular embodiments, the extract may have a water concentration which is greater than or equal to about 2 percent and clarifying the extract may be performed so that the clarified extract has a water concentration which is less than about 2 percent.

In some particular embodiments, the extract may have a BS&W content which is greater than or equal to about 2 percent and clarifying the extract may be performed so that the clarified extract has a BS&W content which is less than about 2 percent.

In some particular embodiments, the extract may have a BS&W content which is greater than or equal to about 0.5 percent and clarifying the extract may be performed so that the clarified extract has a BS&W content which is less than about 0.5 percent.

In some particular embodiments, the extract may be clarified by subjecting the extract to centrifuging in order to produce the clarified extract as an overflow product. In some particular embodiments, the extract may be clarified by subjecting the extract to centrifuging in a disc type centrifuge.

In some particular embodiments, the extract may be clarified by subjecting the extract to gravity settling in order to produce the clarified extract as an overflow product. In some embodiments, the extract may be clarified by subjecting the extract to gravity settling in an inclined plate separator.

In some particular embodiments, clarifying the extract may be further comprised of adding a demulsifier to the extract in order to enhance the clarification of the extract. The demulsifier may be comprised of any suitable substance or combination of substances.

In some particular embodiments, the method may be further comprised of dewatering the conditioned first feed material in order to produce the second feed material. The conditioned first feed material may be dewatered in any suitable manner.

In some particular embodiments, dewatering the conditioned first feed material may be comprised of subjecting the conditioned first feed material to gravity settling in order to produce the second feed material as an overflow product.

In some particular embodiments, dewatering the conditioned first feed material may be comprised of subjecting the conditioned first feed material to thickening in order to produce the second feed material as an underflow product. Subjecting the conditioned first feed material to thickening may be comprised of adjusting the pH of the conditioned first feed material and/or using process aids in order to enhance the separation of water from the conditioned first feed material.

In some particular embodiments, separating the froth treatment tailings into the coarse mineral material fraction and the fine mineral material fraction and providing the fine mineral material fraction as the first feed material may be performed so that the first feed material amount of the tailings bitumen is between about 0.65 times and about 0.85 times the original amount of the tailings bitumen by weight.

In some particular embodiments, conditioning the first feed material may be performed so that the conditioned first feed material amount of the tailings bitumen is between about 0.6 times and about 0.95 times the first feed material amount of the tailings bitumen. In some particular embodiments in which conditioning the first feed material is further comprised of subjecting the first feed material to froth flotation, the conditioned first feed material amount of the tailings bitumen may be as much as about 0.95 times the first feed material amount of the tailings bitumen.

In some particular embodiments, subjecting the second feed material to solvent extraction may be performed so that the extract amount of the tailings bitumen is between about 0.7 times and about 0.95 times the second feed material amount of the tailings bitumen.

In some particular embodiments the method may be performed so that the extract amount of the tailings bitumen is between about 0.6 times and about 0.8 times the first feed material amount of the tailings bitumen. In some particular embodiments, the method may be performed so that the clarified extract amount of the tailings bitumen is between about 0.6 times and about 0.8 times the first feed material amount of the tailings bitumen.

The method of the invention may be performed at any suitable temperature. For example, the method of the invention may be performed at any temperature above the freezing temperature of the feed materials, although temperatures at or higher than ambient temperature (i.e., at or higher than about 20 degrees Celsius) may be preferred for optimizing the performance of the method.

In some particular embodiments, conditioning of the first feed material is performed so that the first feed material has a temperature of between about 50 degrees Celsius and about 95 degrees Celsius. In some particular embodiments, subjecting the second feed material to solvent extraction is performed so that the second feed material has a temperature of between about 50 degrees Celsius and about 95 degrees Celsius.

BRIEF DESCRIPTION OF DRAWINGS

Embodiments of the invention will now be described with reference to the accompanying drawings, in which:

FIG. 2 is a material balance for a laboratory bench scale experiment with respect to an embodiment of the method of the invention similar to that depicted in FIG. 1, conducted on a fine mineral material fraction of froth treatment tailings, using naphtha as a hydrocarbon diluent, wherein the froth treatment tailings are comprised of an amount of naphtha as a froth treatment diluent.

FIG. 3 is a material balance for a laboratory bench scale experiment with respect to a two-stage countercurrent solvent extraction followed by clarifying of the extract to produce a clarified extract, conducted on froth treatment tailings in their entirety, using toluene as a hydrocarbon diluent, wherein the froth treatment tailings result from a froth treatment process using a paraffinic type diluent, wherein the froth treatment tailings have been subjected to a solvent recovery process, and wherein the froth treatment tailings contain no measurable amount of the paraffinic type diluent.

DETAILED DESCRIPTION

Figure 1:
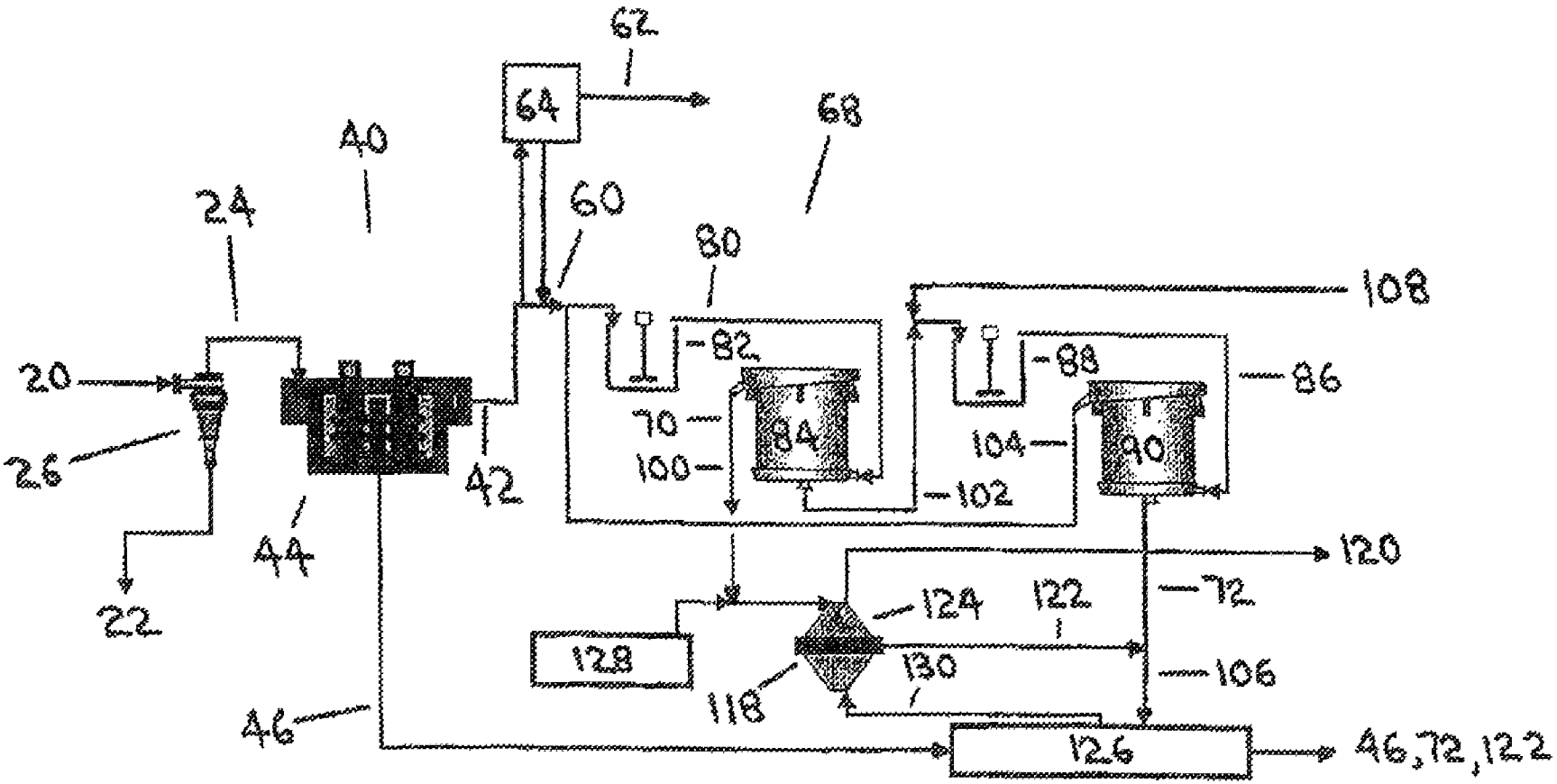
FIG. 1 is a schematic process flow diagram of an embodiment of the method of the invention.

The present invention is a method for recovering bitumen (i.e., tailings bitumen) from froth treatment tailings.

The froth treatment tailings result from a process for recovering bitumen from oil sand. The process for recovering bitumen from oil sand is comprised of producing a bitumen froth from the oil sand and is further comprised of separating the froth treatment tailings from the bitumen froth in a froth treatment process.

The process for recovering bitumen from oil sand may be comprised of any water based oil sand extraction process which is capable of producing the bitumen froth. Separating the froth treatment tailings from the bitumen froth may be comprised of any suitable froth treatment process, including without limitation, processes using a froth treatment diluent and gravity settlers and/or enhanced gravity separation apparatus.

A typical bitumen froth may be comprised of about 60 percent bitumen, about 30 percent water and about 10 percent solid mineral material by weight. Bitumen froth may therefore be characterized generally as containing, in decreasing order of amount by weight: (1) bitumen; (2) water; and (3) solid mineral material.

Typical froth treatment tailings may be comprised of between about 3 percent and about 12 percent tailings bitumen and froth treatment diluent (if the froth treatment tailings contain a froth treatment diluent), between about 15 percent and about 20 percent solid mineral material, with the balance being comprised primarily of water. Froth treatment tailings may therefore be characterized generally as containing, in decreasing order of amount by weight: (1) water; (2) solid mineral material; and (3) tailings bitumen.

In the practice of the present invention, the froth treatment tailings may or may not contain a froth treatment diluent. For example, the froth treatment tailings may result from a froth treatment process in which no froth treatment diluent is used, or the froth treatment tailings may have been subjected to a tailings solvent recovery unit (TSRU) process or a similar process in which substantially all of the froth treatment diluent has been recovered from the froth treatment tailings.

The method of the invention may be performed using the froth treatment tailings in their entirety as a feed material. Alternatively, the method of the invention may be performed using a feed material which is derived from the froth treatment tailings.

Referring to FIG. 1, a schematic process flow diagram according to an embodiment of the method of the invention is provided.

Referring to FIG. 1, froth treatment tailings (20) resulting from a froth treatment process (not shown) and comprising solid mineral material, water and an original amount of the tailings bitumen are first provided. In the embodiment depicted in FIG. 1, the froth treatment tailings (20) also comprise an amount of a naphthenic type froth treatment diluent which is used in the froth treatment process.

As depicted in FIG. 1, the froth treatment tailings (20) are separated into a coarse mineral material fraction (22) and a fine mineral material fraction which is provided as a first feed material (24). In the embodiment depicted in FIG. 1, the froth treatment tailings (20) are separated using a hydrocyclone (26).

The coarse mineral material fraction (22) may be further processed to recover tailings bitumen and/or heavy minerals therefrom (not shown). An exemplary process for recovering tailings bitumen and/or heavy minerals from the coarse mineral material fraction (22) is described in Canadian Patent Application No. 2,548,006 (Erasmus et al) and corresponding U.S. Patent Application Publication No. US 2007/0272596 A1 (Erasmus et al).

The first feed material (24) is therefore derived from the froth treatment tailings (20) and is comprised of solid mineral material, water and a first feed material amount of the tailings bitumen. The first feed material (24) is also comprised of an amount of the naphthenic type froth treatment diluent from the froth treatment tailings (20).

In the embodiment depicted in FIG. 1, the first feed material (24) is first subjected to conditioning (40) in order to produce a conditioned first feed material (42) comprised of solid mineral material, water, and a conditioned first feed material amount of the tailings bitumen. The conditioned first feed material (42) is also comprised of an amount of the naphthenic type froth treatment diluent from the first feed material (24).

Conditioning (40) the first feed material (24) is comprised of agitating the first feed material (24) in order to facilitate separation of the tailings bitumen from the solid mineral material.

In the embodiment of FIG. 1, conditioning (40) the first feed material (24) is further comprised of concentrating the first feed material (24) so that a concentration of the tailings bitumen by weight in the conditioned first feed material (42) is greater than a concentration of the tailings bitumen by weight in the first feed material (24).

As depicted in FIG. 1, conditioning (40) the first feed material (24), including both agitating the first feed material (24) and concentrating the first feed material (24) is performed by subjecting the first feed material (24) to froth flotation in a froth flotation apparatus (44). As depicted in FIG. 1, the froth flotation apparatus (44) is comprised of an agitator or mixer for agitating the first feed material (24) in the froth flotation apparatus (44). Alternatively, the first feed material (24) may be passed through a separate agitator or mixer before being subjected to froth flotation in the froth flotation apparatus (44).

Conditioning the first feed material (24) in the froth flotation apparatus (44) produces the conditioned first feed material (42) as an overflow product and produces froth flotation tailings (46) as an underflow product. The froth flotation tailings (46) may be disposed of in any suitable manner.

A second feed material (60) is derived from the conditioned first feed material (42). The second feed material (60) is comprised of solid mineral material, water, and a second feed material amount of the tailings bitumen. The second feed material (60) is also comprised of an amount of the froth treatment diluent from the conditioned first feed material (42).

The conditioned first feed material (42) in its entirety may be provided as the second feed material (60). Alternatively, as depicted in FIG. 1, the conditioned first feed material (42) may be dewatered in a dewatering apparatus (64) order to produce the second feed material (60).

As depicted in FIG. 1, the dewatering apparatus (64) is comprised of a gravity settler so that dewatering the conditioned first feed material (42) is performed by subjecting the conditioned first feed material (42) to gravity settling in order to produce the second feed material (60) as an overflow product and dewatering tailings (62) as an underflow product. The dewatering tailings (62) may be disposed of in any suitable manner.

The second feed material (60) is subjected to solvent extraction (68) in order to produce an extract (70) and a raffinate (72).

As depicted in FIG. 1, the solvent extraction (68) is performed using two stages of solvent extraction apparatus which are arranged in a countercurrent configuration. As depicted in FIG. 1, the first stage solvent extraction apparatus (80) is comprised of a first mixer (82) and a first gravity settler (84) and the second stage solvent extraction apparatus (86) is comprised of a second mixer (88) and a second gravity settler (90). As depicted in FIG. 1, each of the gravity settlers (84, 90) is comprised of a gravity settling vessel.

The second feed material (60) is delivered to the first mixer (82) for mixing and is then delivered to the first gravity settler (84) in order to produce a first stage extraction overflow product (100) and a first stage extraction underflow product (102).

The first stage underflow product (102) is delivered to the second mixer (88) for mixing and is then delivered to the second gravity settler (90) in order to produce a second stage extraction overflow product (104) and a second stage extraction underflow product (106).

An amount of a hydrocarbon diluent (108) is also delivered to the second mixer (88) for mixing with the first stage underflow product (102). The hydrocarbon diluent (108) is selected having regard to the composition of the froth treatment diluent. In the embodiment of FIG. 1, the hydrocarbon diluent (108) and the froth treatment diluent are comprised of a single naphthenic type diluent.

The second stage extraction overflow product (104) is recycled to the first mixer (82). The second stage extraction underflow product (106) is the raffinate (72) and may be disposed of in any suitable manner. The first stage extraction overflow product (100) is the extract (70).

The raffinate (72) may be subjected to a solvent recovery process before disposal in order to recover substantially all or a portion of the froth treatment diluent and the hydrocarbon diluent (108) therefrom.

The extract (70) is comprised of solid mineral material, water, and an extract amount of the tailings bitumen. The extract (72) is also comprised of an amount of the froth treatment diluent from the second feed material (60) and an amount of the hydrocarbon diluent (108) which is present in the extract (70) as a result of the recycling of the second stage extraction overflow product (104) to the first mixer (82).

The extract (70) has a solid mineral material concentration by weight and a water concentration by weight (collectively referred to as the "BS&W content"). If the solid mineral material concentration, the water concentration and the BS&W content in the extract (70) are below acceptable limits, the extract (70) may be suitable for further processing and/or transport as a diluted bitumen (i.e., dilbit) product. The further processing of the extract (70) may be comprised of subjecting the extract (70) to a solvent recovery process for recovering substantially all or a portion of the froth treatment diluent and the hydrocarbon diluent (108) therefrom.

If, however, the solid mineral material concentration and/or the water concentration by weight in the extract (70) are above acceptable limits, the extract (70) may be subjected to clarifying (118) in order to produce a clarified extract (120) which has a reduced solid mineral material concentration by weight and/or water concentration by weight in comparison with the extract (70).

As depicted in FIG. 1, clarifying the extract (70) is comprised of subjecting the extract (70) either to centrifuging or to gravity settling in order to produce the clarified extract (120) as an overflow product and in order to produce clarifying tailings (122) as an underflow product. As depicted in FIG. 1, subjecting the extract (70) to centrifuging is performed in a single stage using a disc-type centrifuge (124).

As depicted in FIG. 1, clarifying the extract (70) is further comprised of adding a demulsifier (128) and an amount of water (130) to the extract (70) in order to enhance the clarification of the extract (70).

The clarifying tailings (122) may be disposed of in any suitable manner. The clarifying tailings (122) may be subjected to a solvent recovery process (126) before disposal in order to recover substantially all or a portion of the froth treatment diluent and the hydrocarbon diluent (108) therefrom.

The froth flotation tailings (46) and the raffinate (72) may similarly be subjected to a solvent recovery process (126) in order to recover substantially all or a portion of the froth treatment diluent and the hydrocarbon diluent (108) therefrom. Although the solvent recovery process (126) is depicted schematically in FIG. 1 as a single process, the solvent recovery process (126) could be comprised of a plurality of processes and apparatus.

The solvent recovery process (126) may be effective to recover water from the clarifying tailings (122), the froth flotation tailings (46) and/or the raffinate (72). As depicted schematically in FIG. 1, the water (130) which is added to the extract (70) may in such circumstances be obtained in whole or in part from the solvent recovery process (126).

The clarified extract (120) may be further processed and/or transported as a diluted bitumen (i.e., dilbit) product. The further processing of the clarified extract (120) may be comprised of subjecting the clarified extract (120) to a solvent recovery process (not shown) for recovering substantially all or a portion of the froth treatment diluent and the hydrocarbon diluent (108) therefrom.

Referring to FIG. 2, a material balance for a laboratory bench scale experiment is provided for an embodiment of the method of the invention similar to the embodiment depicted in FIG. 1, conducted on a fine mineral material fraction of froth treatment tailings, using naphtha as a hydrocarbon diluent, wherein the froth treatment tailings are comprised of an amount of naphtha as a froth treatment diluent. The embodiment of the method of the invention which is the subject of FIG. 2 does not include dewatering the conditioned first feed material (42) in a dewatering apparatus (64), but is otherwise as depicted in FIG. 1. The method represented by the material balance of FIG. 2 was performed at a temperature of about 60 degrees Celsius.

Referring to FIG. 2, the first feed material (24) has a bitumen concentration by weight of about 2 percent, and the conditioned first feed material (42) has a bitumen concentration of about 3.5 percent, so that the ratio of the bitumen concentration in the conditioned first feed material (42) to the bitumen concentration in the first feed material (24) is about 1.75.

Referring to FIG. 2, the bitumen recovery following conditioning (40) of the first feed material (24) is about 84.1 percent, the overall bitumen recovery following solvent extraction (68) is about 78.1 percent, and the overall bitumen recovery following clarifying (118) is about 77.8 percent.

Referring to FIG. 2, the solvent to feed material ratio by weight for the first stage (80) solvent extraction is about 0.194 and the solvent to feed material ratio by weight for the second stage (86) solvent extraction is about 0.148. The solvent to bitumen ratio by weight for the first stage (80) solvent extraction is about 5.18 and the solvent to bitumen ratio by weight for the second stage (86) solvent extraction is about 20.15.

Referring to FIG. 3, a material balance for a laboratory bench scale experiment is provided for a two-stage countercurrent solvent extraction followed by clarifying of the extract to produce a clarified extract, conducted on froth treatment tailings in their entirety, using toluene as a hydrocarbon diluent, wherein the froth treatment tailings result from a froth treatment process using a paraffinic type diluent as a froth treatment diluent, wherein the froth treatment tailings have been subjected to a solvent recovery process, and wherein the froth treatment tailings contain about 0.4 percent by weight of the paraffinic type diluent. The method represented by the material balance of FIG. 3 was performed at a temperature of about 20 degrees Celsius and does not include conditioning (40) of the first feed material (24).

Referring to FIG. 3, the overall bitumen recovery following solvent extraction (118) is about 92.7 percent, and the overall bitumen recovery following clarifying (118) is about 89 percent.

Referring to FIG. 3, the solvent to feed material ratio by weight for the first stage (80) solvent extraction is about 0.27 and the solvent to feed material ratio by weight for the second stage (86) solvent extraction is about 0.31. The solvent to bitumen ratio by weight for the first stage (80) solvent extraction is about 3.41 and the solvent to bitumen ratio by weight for the second stage (86) solvent extraction is about 38.6.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. A method for recovering a tailings bitumen from a froth treatment tailings comprising solid mineral material, water, and an original amount of the tailings bitumen, wherein the froth treatment tailings result from a process for recovering bitumen from oil sand, wherein the process for recovering bitumen from oil sand is comprised of producing a bitumen froth from the oil sand, and wherein the process for recovering bitumen from oil sand is further comprised of separating the froth treatment tailings from the bitumen froth in a froth treatment process, the method comprising:

(a) providing a first feed material which is derived from the froth treatment tailings, wherein the first feed material consists essentially of solid mineral material, water, a first feed material amount of the tailings bitumen, and an amount of a froth treatment diluent;

(b) conditioning the first feed material in order to produce a conditioned first feed material, wherein conditioning the first feed material is comprised of agitating the first feed material in order to facilitate separation of the tailings bitumen from the solid mineral material, and wherein the conditioned first feed material is comprised of solid mineral material, water, and a conditioned first feed material amount of the tailings bitumen;

(c) providing a second feed material which is derived from the conditioned first feed material, wherein the second feed material is comprised, of solid mineral material, water, and a second feed material amount of the tailings bitumen;

(d) subjecting the second feed material to solvent extraction in order to produce an extract comprising solid mineral material, water, and an extract amount of the tailings bitumen; and (e) clarifying the extract in order to produce a clarified extract, wherein the clarified extract is comprised of solid mineral material, water, and a clarified extract amount of the tailings bitumen, and wherein a concentration of the solid mineral material and the water by weight in the clarified extract is less than a concentration of the solid mineral material and the water by weight in the extract.

2. The method as claimed in claim 1 wherein subjecting the second feed material to solvent extraction is comprised of adding an amount of a hydrocarbon diluent to the second feed material.

3. The method as claimed in claim 2 wherein the froth treatment diluent is present in the first feed material as a result of separating the froth treatment tailings from the bitumen froth.

4. The method as claimed in claim 3 wherein the hydrocarbon diluent is selected to be compatible with the froth treatment diluent.

5. The method as claimed in claim 4 wherein the froth treatment diluent and the hydrocarbon diluent are comprised of a single naphthenic type diluent.

6. The method as claimed in claim 2 wherein the hydrocarbon diluent is a naphthenic type diluent.

7. The method as claimed in claim 6 wherein the naphthenic type diluent has an aromaticity of between 10 and 20 percent.

8. The method as claimed in claim 6 wherein the naphthenic type diluent is comprised of naphtha.

9. The method as claimed in claim 6 wherein the naphthenic type diluent is comprised of toluene.

10. The method as claimed in claim 1, wherein conditioning the first feed material is further comprised of concentrating the first feed material so that a concentration of the tailings bitumen by weight in the conditioned first feed material is greater than a concentration of the tailings bitumen by weight in the first feed material.

11. The method as claimed in claim 10 wherein conditioning the first feed material is performed so that the concentration of the tailings bitumen by weight in the conditioned first feed material is between 1.25 times and 3 times the concentration of the tailings bitumen by weight in the first feed material.

12. The method as claimed in claim 10 wherein conditioning the first feed material is performed so that the conditioned first feed material amount of the tailings bitumen is between 0.6 times and 0.95 times the first feed material amount of the tailings bitumen by weight.

13. The method as claimed in claim 10 wherein the extract amount of the tailings bitumen is between 0.6 times and 0.8 times the first feed material amount of the tailings bitumen by weight.

14. The method as claimed in claim 10 wherein concentrating the first feed material is comprised of subjecting the first feed material to froth flotation in order to produce the conditioned first feed material as an overflow product.

15. The method as claimed in claim 14 wherein subjecting the first feed material to froth flotation is comprised of agitating the first feed material so that agitating the first feed material and concentrating the first feed material are both comprised of subjecting the first feed material to froth flotation.

16. The method as claimed in claim 1, further comprising dewatering the conditioned first feed material in order to produce the second feed material.

17. The method as claimed in claim 16 wherein dewatering the conditioned first feed material is comprised of subjecting the conditioned first feed material to gravity settling in order to produce the second feed material as an overflow product.

18. The method as claimed in claim 1 wherein clarifying the extract is comprised of subjecting the extract to centrifuging in order to produce the clarified extract as an overflow product.

19. The method as claimed in claim 1 wherein clarifying the extract is comprised, of subjecting the extract to centrifuging in a disc type centrifuge.

20. The method as claimed in claim 1 wherein clarifying the extract is comprised of subjecting the extract to gravity settling in order to produce the clarified extract as an overflow product.

21. The method as claimed in claim 1 wherein clarifying the extract is comprised of adding a demulsifier to the extract.

22. The method as claimed in claim 1 wherein clarifying the extract is comprised of subjecting the extract to electrostatic precipitation in order to produce the clarified extract as a purified product.

23. The method as claimed in claim 1 wherein the concentration of the solid mineral material in the extract is greater than or equal to 0.1 percent by weight and wherein the concentration of the solid mineral material in the clarified extract is less than 0.1 percent by weight.

24. The method as claimed in claim 1 wherein the concentration of the water in the extract is greater than or equal to 2 percent by weight and wherein the concentration of the water in the clarified extract is less than 2 percent by weight.

25. The method as claimed in claim 1 wherein the concentration of the solid mineral material and the water in the extract is greater than or equal to 2 percent by weight and wherein the concentration of the solid mineral material and the water in the clarified extract is less than 2 percent by weight.

26. The method as claimed in claim 1 wherein the concentration of the solid mineral material and the water in the extract is greater than or equal to 2 percent by weight and wherein the concentration of the solid mineral material and the water in the clarified extract is less than 1 percent by weight.

27. The method as claimed in claim 1 wherein the clarified extract amount of the tailings bitumen is between 0.6 times and 0.8 times the first feed material amount of the tailings bitumen by weight.

28. The method as claimed in claim 2 wherein subjecting the second feed material to solvent extraction is further comprised of subjecting the second feed material to gravity settling.

29. The method as claimed in claim 2 wherein subjecting the second feed material to solvent extraction is further comprised of passing the second feed material through a plurality of stages of solvent extraction apparatus arranged in a countercurrent configuration.

30. The method as claimed in claim 29 wherein the hydrocarbon diluent consists essentially of a naphthenic type diluent and wherein passing the second feed material through a first stage of solvent extraction apparatus is performed at a solvent to feed material ratio of between 0.09 and 1 by weight.

31. The method as claimed in claim 29 wherein the hydrocarbon diluent consists essentially of a naphthenic type diluent and wherein passing the second feed material through a second stage of solvent extraction apparatus is performed at a solvent to feed material ratio of between 0.1 and 1 by weight.

32. The method as claimed in claim 2 wherein subjecting the second feed material to solvent extraction is further comprised of passing the second feed material through a plurality of stages of gravity settlers arranged in a countercurrent configuration.

33. The method as claimed in claim 2 wherein subjecting the second feed material to solvent extraction is further comprised of passing the second feed material through a rotary disc contactor apparatus.

34. The method as claimed in claim 1 wherein the froth treatment tailings are comprised of a coarse mineral material fraction and a fine mineral material fraction and wherein providing the first feed material is comprised of providing the fine mineral material fraction as the first feed material.

35. The method as claimed in claim 34 wherein the first feed material amount of the tailings bitumen is between 0.65 times and 0.85 times the original amount of the tailings bitumen by weight.

36. The method as claimed in claim 1, further comprising separating the froth treatment tailings into a coarse mineral material fraction and a fine mineral material fraction, and further comprising providing the fine mineral material fraction as the first feed material.

37. The method as claimed in claim 36 wherein separating the froth treatment tailings into the coarse mineral material fraction and the fine mineral material fraction is comprised of subjecting the froth treatment tailings to hydrocycloning.

38. The method as claimed in claim 1 wherein conditioning the first feed material is performed so that the first feed material has a temperature of between 50 degrees Celsius and 95 degrees Celsius.

39. The method as claimed in claim 1 wherein subjecting the second feed material to solvent extraction is performed so that the second feed material has a temperature of between 50 degrees Celsius and 95 degrees Celsius.

40. The method as claimed in claim 1 wherein subjecting the second feed material to solvent extraction is performed so that the extract amount of the tailings bitumen is between 0.7 times and 0.95 times the second feed material amount of the tailings bitumen by weight.

* * * * *